United States Patent [19]

Asfura et al.

[11] 3,948,283

[45] Apr. 6, 1976

[54] ROTARY SYPHON

[76] Inventors: Abraham C. Miselem Asfura; Abraham A. Miselem Alfonsa, both of Apartado Postal 31452, Mexico City, Mexico

[22] Filed: June 26, 1973

[21] Appl. No.: 373,812

[30] Foreign Application Priority Data

June 30, 1972 Mexico ..... 136678

[52] U.S. Cl. ..... 137/152; 137/580; 137/590; 34/125

[51] Int. Cl. ..... F26b 11/04

[58] Field of Search ..... 137/580, 590, 592, 577, 137/579, 152; 34/124, 125

[56] References Cited

UNITED STATES PATENTS

| | | | |
|---|---|---|---|
| 1,822,092 | 9/1931 | Hansen | 137/577 X |
| 1,948,963 | 2/1934 | Dukes | 137/580 X |
| 1,953,525 | 4/1934 | Young | 137/580 X |
| 2,164,445 | 7/1939 | Bridge | 137/592 |
| 2,291,131 | 7/1942 | Armstrong | 137/580 X |
| 2,308,137 | 1/1943 | White | 137/580 |
| 3,009,261 | 11/1961 | Hieronymus | 137/590 X |

*Primary Examiner*—William R. Cline

*Attorney, Agent, or Firm*—Hopgood, Calimafde, Kalil, Blaustein & Lieberman

[57] ABSTRACT

The invention contemplates an improved rotary-syphon construction whereby condensate may be syphoned from the inner wall of a rotating drum, for example, a steam-heated dryer. The improvement resides in the particular construction whereby syphon parts are axially removably insertable through a journal bearing at one end of the drum, and whereby internally projecting parts of the syphon derive direct and firm radial-positioning support, thereby relieving syphon-tube parts from any need to sustain the stress fluctuation which would otherwise result from reliance upon cantilevered support of the syphon-tube parts solely at the journal-bearing region.

10 Claims, 6 Drawing Figures

ROTARY SYPHON

The invention relates to an improved rotary-syphon construction whereby condensate or other fluid may be syphoned from the inner wall of a rotating drum, for example, a steam-heated rotary dryer rotated on a horizontal orientation of its axis.

In devices of the character indicated, it has been the practice to axially insert syphon-tube structure through the bore of a main journal bearing of the drum to be syphoned. The syphon-tube structure is clamped to the bore of the bearing so that its parts which project internally of the drum are cantilevered from the journal bearing. This cantilevered situation necessarily subjects the internally projected parts to cyclic stress reversals in the course of drum rotation, resulting ultimately in breakage within the drum. It thus becomes difficult and costly to inspect and maintain such a syphon structure.

It is, accordingly, an object of the invention to provide a rotary-syphon structure which avoids the above-noted deficiency of prior structures.

It is a specific object to provide a rotary-syphon construction wherein cantilever action on syphon components is entirely relieved.

Another specific object is to provide such an improved structure wherein syphon and syphon-support parts are readily removable, for inspection and maintenance purposes.

A further specific object is to meet the above objects with a construction in which all syphon parts are positively and directly positioned with respect to drum or drum-supported parts, thereby avoiding stress reversals in syphon parts in the course of drum rotation.

Other objects and various further features of novelty and invention will be pointed out or will occur to those skilled in the art from a reading of the following specification in conjunction with the accompanying drawings. In said drawings, which show, for illustrative purposes only, a preferred form of the invention:

Figures 1, 2, 3, 4:
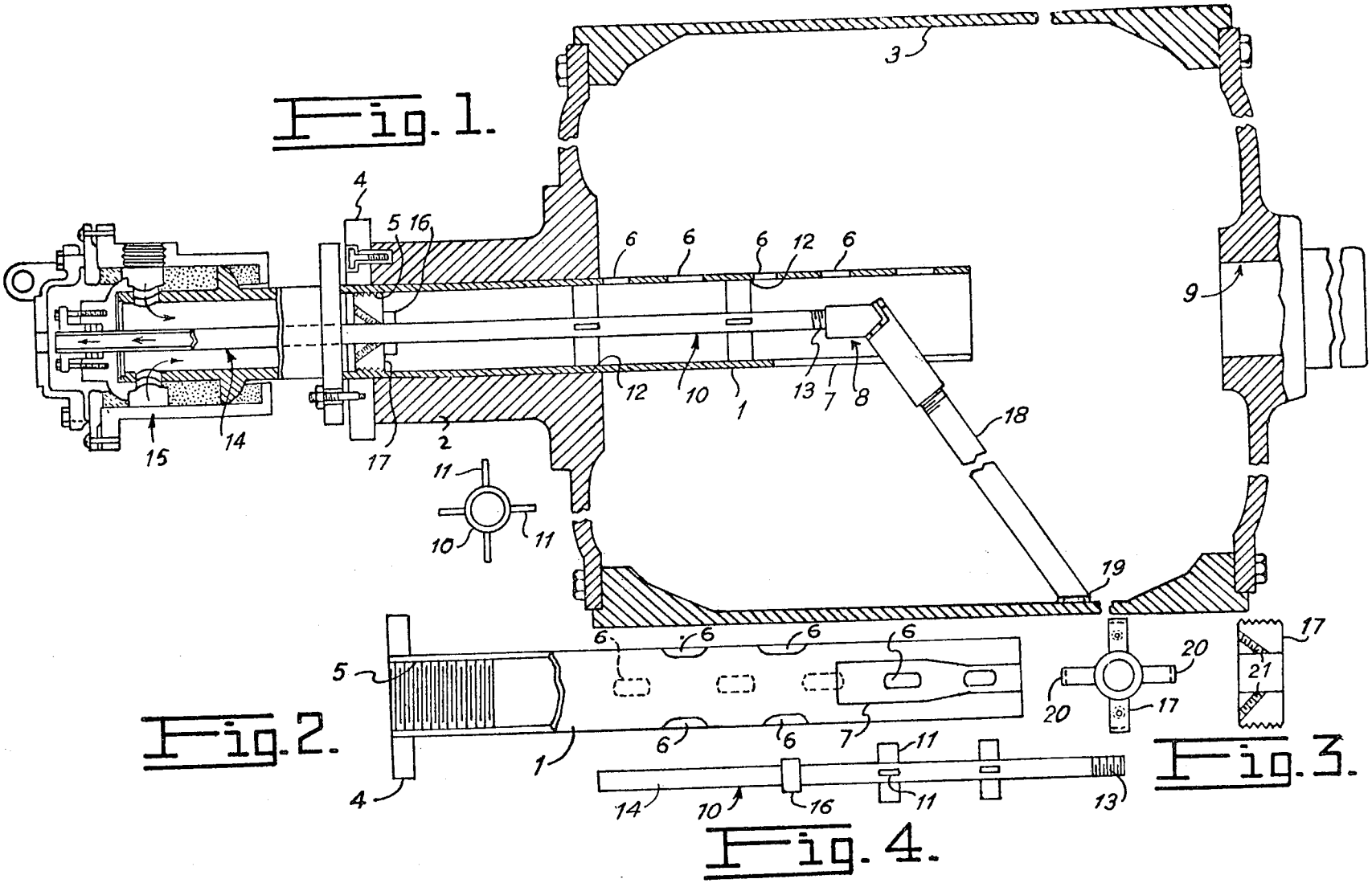
FIG. 1 is a longitudinal sectional view of a dryer roll or drum to which a rotary-syphon structure of the invention has been applied.
FIG. 2 is a view in elevation, partly broken-away and in section, to show a supporting tube forming part of the structure of FIG. 1, and viewed from beneath the showing of said tube in FIG. 1.

FIGS. 3 and 4, respectively, are front-end and longitudinal-sectional views of a spider nut forming part of the structure of FIG. 1; and FIGS. 5 and 6, respectively, are longitudinal-elevation and front-end views of the horizontal-tube portion of the syphon structure of FIG. 1.

Referring to said figures, syphon-tube structure of the invention is shown in application to a rotary dryer roll or drum 3 having left and right main journal bearings 2, 9 for rotary support and drive. Both bearings may have like aligned bores, as shown, for reception and support of a single elongated central supporting tube 1 of the invention; however, for the proportions shown for drum 3, it is sufficient to rely solely on bearing 2 for support of tube 1, so that the axially inner end thereof projects well into the inner volume of drum 3. Tube 1 derives axially extensive, coaxial-positioning support from the bore of bearing 2 and it includes an outer radial flange 4, by which it is removably secured (bolted) to the axial end of bearing 2. For a purpose to be later explained, the axially outer end of the bore of the supporting tube 1 is threaded, at 5. Also, a plurality of openings 6 in the wall of tube 1 facilitate radial distribution of heating fluid to the inner volume of the drum, and an enlarged opening 7 at an axially inner and generally central location (within drum 3) accommodates certain parts of the syphon-tube structure; as shown in FIG. 2, opening 7 is characterized by a first zone which has an axially elongate and relatively wide angular span, and this wide zone axially inwardly communicates with a second zone having a relatively narrow angular span, there being a connecting zone in which side walls or edges of the opening gradually converge between the first and second zones.

Syphon-tube structure insertably receivable within the described supporting tube 1 comprises a horizontal-tube element 10 and a radial-tube element 18 having articulated connection at an elbow or hinge 8; each of tube elements 10, 18 is shown threaded as at 13 into one of the hinged elements of elbow 8, so that such elbow-hinge parts are necessarily of slightly greater diameter than either of tube elements 10, 18. Preferably, and as shown, such slightly greater diameter effectively exceeds the narrow span of the second zone of opening 7 and is less than the relatively wide span of the first zone of opening 7, thereby establishing an interference relation between the radial hinged element of elbow 8 and the edges of the convergent zone of opening 7.

The horizontal-tube element 10 of the syphon is provided with angularly spaced radial struts 11 at each of a plurality of axially spaced locations, importantly including at least one such location axially inwardly of the bearing-support region of tube 1 and close to the threaded end of tube element 10. Struts 11 are carried as part of the subassembly of syphon-tube element 10 (FIGS. 5 and 6) and are sized to slidably engage and pilot upon the bore of the supporting tube 1, thereby relieving tube element 10 from any need to sustain bending stresses that could result from a cantilevered mounting of tube element 10. At its axially outer end, tube element 10 projects at 14 beyond the axially outer end of supporting tube 1 and its mounting flange 4, for introduction into a rotary joint or fluid coupling 15, shown with a mounting flange removably secured to the supporting-tube flange 4. Within the threaded region 5 of supporting tube 1, a stop collar or flange 16 forms part of the horizontal-tube element 10 and is the means whereby a spider nut 17 (engaged to threads 5) can apply axially inward force to the horizontal tube element 10; upon application of such force against the above-noted interference (radial element of elbow 8, wedged into the convergent zone of opening 7), the radial-tube element 18 is driven into bearing contact at 19 with the inner wall of drum 3, and all syphon parts are firmly and rigidly located, with assurance that no part of the syphon structure can or will be subjected to bending-stress fluctuation, and regardless of drum rotation. As shown in FIGS. 3 and 4, the spider nut 17 comprises a central hub or collar slidably guided on the horizontal-tube element 10 and having integral spaced radial arms, the outer surfaces 20 of which are thread-finished; the syphon-clamping position of spider nut 17 is held by set-screw means 21 driven into binding engagement with tube element 20.

In use, the syphon-tube structure is applied to drum 3 by first installing the supporting tube 1, the same being well supported within the bore of main bearing 2, and bolted thereto at flange 4, the large opening 7 being downwardly oriented. Thereafter, the syphon assembly of parts 10, 11, 16, 8, 18, 19 is axially inserted into tube 1, the same deriving central piloting support as struts 11 engage and slide upon the bore of tube 1. The free end of radial-tube element 18 rides the bore of tube 1 until it is able to enter the large opening 7 and, upon further axial insertion, the hinge action at elbow 8 permits tube element 18 to become progressively more radially oriented. When bearing 19 encounters the inner wall of drum 3, it slides axially until the above-noted interference develops, and application of nut 17 enables the interference fit to be clamped into rigidity. The rotary joint 15 may then be applied and clamped, to complete the installation. No mechanical looseness or stress fluctuation can develop during drum rotation, fluid circulation being as suggested by arrows in FIG. 1, i.e., steam or other heating medium admitted via the radial ports of joint 15 and passed axially into drum 3 via the annular space between tubes 1, 10, and via the distribution openings 6; condensate syphoned by tube 18 is conducted via elbow 8 and tube 10 for external discharge from the axially outer end 14 of tube 10.

To remove the entire syphon structure (10, 8, 18) for inspection, maintenance or replacement, the joint 15 is first removed and then nut 17 is unthreaded, thus relieving the clamped interference and exposing tube end 14 for grasping and axial removal. The hingedly connected radial-tube element 18 merely retracts into the bore of tube 1 in the course of such removal.

The described structure will be seen to achieve all stated objects, without undue restriction of the passage of fluid. In other words, the radial clearance between tubes 1 and 10, the angular spacing between struts 11, and the angular spacing between arms of spider 17 may be designed such that no impediment exists to the desired steam or the like fluid flow.

It will be understood that for the variety of elbow 8 in which there is a stopped outer limit for the acute angle of hinged articulation, it may in certain cases not be necessary or desirable to drive the outer end of the radial-tube element 18 into abutment with the inner wall of the drum. In such event, the outer end of element 18 will be spaced to clear the drum 3, and the setting of nut 17 will jam the described interference against the stop action of elbow 8 at its outer limit of articulation.

Various other modifications will become apparent to those skilled in the art upon a reading of this specification. Such modifications are intended to be encompassed within the scope of the claimed invention.

We claim:

1. A rotary -syphon assembly for axial insertion into a rotary drum to be heated by a flow of heated fluid, the drum having at the insertion end a main journal with an axial bore, said assembly comprising: an elongated supporting tube sized for axially slidable insertion through the journal bore and for firm support in the journal bore when the axially inner end of said tube is cantilevered beyond the axially inner limit of journal-bore support, the cantilevered portion of said tube having an enlarged opening at one angular location and spaced from the axially inner limit of journal-bore support; articulated syphon-tube means comprising a horizontal-tube element, a radial-tube element, and a hinged elbow interconnecting said tube elements, said tube elements and elbow being of lesser diameter than the bore of said supporting tube; radial-strut means providing direct radial-positioning support of said horizontal tube element with respect to the bore of said support tube at plural axially spaced locations at least one of which is near said elbow; the enlarged opening being sized and located to permit said horizontal tube element to pass radially through the enlarged opening upon axial insertion or removal of said syphon-tube means via said supporting tube.

2. The assembly of claim 1, and including selectively operable interengaging means on said syphon-tube means and on said supporting tube for securing an inserted relation thereof wherein said radial-tube element is firmly retained in its radially extending position.

3. The assembly of claim 2, in which said interengaging means includes portions of said radial-tube element and of said supporting tube which interfere at the region of the enlarged opening when said syphon-tube means is fully inserted into said support tube.

4. The assembly of claim 3, in which said interengaging means includes an adjustable axial-displacement actuating mechanism externally accessible at the inlet to said main journal and reacting between said horizontal-tube element and said supporting tube to secure an inserted positioning of said syphon-tube means with said radial-tube element in said interfering relation at the enlarged-opening region of said supporting tube.

5. The assembly of claim 4, in which said axial-displacement actuating mechanism includes a spider nut having threaded engagement to the bore of said supporting tube.

6. The assembly of claim 3, in which said articulated syphon-tube means includes means limiting to an acute angle the extent of radial-tube articulation from alignment with said horizontal-tube element.

7. The assembly of claim 1, in which said radial-tube element includes a drum-contacting support bearing at its outer end and adapted to ride the inner surface of the drum when said syphon-tube means is in assembled relation to said supporting tube.

8. In combination, a rotary drum having a cylindrically bored main bearing at one axial end and a syphon assembly of claim 1 fitted to the bore of said bearing, the fit being of said supporting tube to said bore, with said supporting tube projecting substantially axially inwardly of the drum and beyond the bearing-fitted region, said radial-tube element being of effective length exceeding the radius of the inner wall of said drum, and externally accessible means for securing said syphon-tube elements in position with said radial-tube element in direct abutment with the inner wall of said drum.

9. The assembly of claim 1, in which said supporting tube includes a radial flange at its outer axial end and means for removably securing said flange to the outer axial end of one of the main bearings of a dryer drum.

10. The assembly of claim 1, in which the cantilevered projecting portion of said supporting tube has a plurality of openings for radially outward distribution of fluid entering via the axially outer end of said tube.

* * * * *